United States Patent [19]

Szewalski

[11] 4,284,388

[45] Aug. 18, 1981

[54] MOVING BLADE FOR THERMIC AXIAL TURBOMACHINES

[75] Inventor: Robert Szewalski, Gdansk-Wrzeszcz, Poland

[73] Assignee: Polska Akademia Nauk, Instytut Maszyn Przeplywowych, Gdansk, Poland

[21] Appl. No.: 8,397

[22] Filed: Feb. 1, 1979

Related U.S. Application Data

[63] Continuation of Ser. No. 738,175, Nov. 2, 1976.

[30] Foreign Application Priority Data

Nov. 3, 1975 [PL] Poland ..... 184450

[51] Int. Cl.[3] ..... F01D 5/14

[52] U.S. Cl. ..... 416/223 A; 416/242; 415/119

[58] Field of Search ..... 416/223 A, 242, DIG. 2; 415/181, 119

[56] References Cited

U.S. PATENT DOCUMENTS

| | | | |
|---|---|---|---|
| 2,660,401 | 11/1953 | Hull | 416/223 A |
| 3,065,933 | 11/1962 | Williams | 416/242 X |
| 3,169,694 | 2/1965 | Borchers | 416/242 X |
| 3,851,994 | 12/1974 | Seippel | 416/223 A |

FOREIGN PATENT DOCUMENTS

| | | | |
|---|---|---|---|
| 2144600 | 3/1973 | Fed. Rep. of Germany | 416/242 |
| 577108 | 7/1976 | Switzerland | 416/213 R |

*Primary Examiner*—Everette A. Powell, Jr.
*Attorney, Agent, or Firm*—Haseltine & Lake

[57] ABSTRACT

The invention finds application in the manufacture of working blades of a length exceeding that of the blades known so far, without infringing the limitations issuing from flow considerations and strength of the rotor. The blade comprises two different sheets deliminated by a suitably selected intermediary cross section of the blade. Each of the sheets is formed according to a different law dictated by strength and flow considerations. Beginning from the cross-section which delimits the sheets, the sheets are twisted in opposite directions.

1 Claim, 4 Drawing Figures

MOVING BLADE FOR THERMIC AXIAL TURBOMACHINES

This is a continuation of application Ser. No. 738,175, filed 11/2/76.

The object of the invention is a working blade for steam and gas turbines and axial compressors, a long blade in particular, which finds its application at the outlet i.e. at the last stage in turbines and at the inlet i.e. at the first stage in compressors.

The known working blades in thermal turbomachines—gas and steam turbines and axial compressors—present always and without exception monolithic constructions. These long blades are in the form of sheets which taper from the root to the tip. They are also twisted by which the variability of inlet and outlet angles is achieved. In the known long blades the inlet angle increases from an acute angle at the blade root to an obtuse angle at its top with possible simultaneous decrease of the angle at the outlet. This variability of blade angles called the law of blade twisting can, in principle, differ considerably. However, all the known types of blades so far are twisted according to one concrete low and the blade surfaces obtained in such a manner are continuous in nature which, in principle, can be described by means of analytic equations.

The maximum section of flow A through a blade system that can be designed from the viewpoint of strength is a function of three values:

angular velocity of rotation material constant defined as the ratio of allowable tensile stress to material density $\sigma_r/\rho$, and structural factor k expressing the ratio of tensile stress occurring in identical root sections of two blades, namely, a true blade, twisted, tapering and thinning from the root to the tip, and a cylindrical blade with a constant cross-section equal to the root section.

On the other hand, the section of flow through the blade system is determined in relation to the consideration $$A = d\pi l\tau \qquad /1/$$

where:

d represents the mean diameter of the circle in which the blade rotates l represents the length of the blade which is equal to half the difference between the outside diameter $d_z$ and the inside diameter $d_w$ of the blade $\tau$ represents the contraction factor of the flow section taking into account the finite thickness of the blade run-off edges.

The maximum section of flow $A_{max}$ as a function of the three parameters $\sigma_r/\rho$, k and angular velocity of rotation $\omega$ does not depend on the selection of blade length of circle mean diameter ratio l/d. For a determined value of l/d ratio, therefore, the mean circle diameter d increases with the increase of the flow section A according to the relation:

$$d = \sqrt{\frac{A}{\pi \cdot l/d \cdot \tau}} \qquad /2/$$

The same increase applies to the extreme diameters, inside $d_w$ and outside $d_z$, of the blade system and to the corresponding rotational velocities. However, the permissible increase of the diameter $d_w$ is limited, since the inside blade diameter determines at the same time the outside diameter of the rotor which supports the blade system on the perimeter. This outside rotor diameter is limited by strength considerations in relation to the constructional type of rotor, e.g. disk of uniform strength, disk with a shaft opening and an appropriate hub, barrel etc.

Thus, for a determined increase of the flow section A an increase in the inside diameter $d_w$ of the blades can be avoided only when correspondingly higher values are assumed for the l/d ratio e.g. from $l/d = \frac{1}{3}$ upwards to values of 1/2.75, 1/2.5 etc.

The described procedure is feasible from the viewpoint of blade strength. However, the passage to large values of l/d ratio, in general, more than $\frac{1}{3}$, is hindered by flow considerations. The latter include exceeding the limiting values of such flow parameters as the degree of reaction or the axial component of velocity of the working medium at the inside or outside diameter of the load-carrying blade. Irrespective of the adopted law of blade twisting and, therefore, irrespective of the assumed law of variability of peripheral and axial velocity components with the radius, the above-mentioned limitations are an unavoidable necessity. With a selected section and profile of the blade chosen as a reference the resulting blade length permissible from the viewpoint of strength will always be limited either in the direction of decreasing radii or in the direction of increasing radii.

Thus, e.g. in the hither to existing state of the art, for the known assumption of free vortex which characterizes the flow of working medium in the blade interfree gap, $$C_u \cdot r = const \qquad /3/$$

where:

$C_u$ is the peripheral component of jet velocity r is the radius determining the location of the blade section under consideration and the length of the blade is limited in the direction of decreasing radii since the degree of reaction also decreases with the radius and its value should always be positive. For the known assumption of forced vortex, $$C_u/r = const \qquad /4/$$

and length of the blade is limited in the direction of increasing radii $r_z$ because of the axial component of velocity $C_a$ which decreases rapidly with an increase in radius.

No matter which law of variability of peripheral component $C_u$ with the radius is selected, limiting parameters are always arrived at, which restrict the permissible length of the blade in relation to the adopted law of $C_u = fr$.

Hence, although it is possible to increase the length of the blades 1 and the section A of free flow through the corresponding stages bearing in mind the strength of the blades, in practice, no effective use of such possibility can be made with the present state of art. This, in turn, restricts the maximum power obtainable in the turbine per outlet and, therefore, the total turbine power.

In the invention the discussed limitations on the increase of blade length are avoided by a design where the working blade is composed of two different sheets, one extending towards the root from a preselected intermediary section and the other extending towards the blade tip. Each of the sheets is formed according to different laws dictated by strength and flow considerations. One of the sheets is formed so that at one of its ends a limiting value of one of the flow factors, i.e. degree of reaction or axial component of the velocity of the working medium, occurs. At this end the blade surface passes directly on to the other sheet which is formed so that the selected factor is held at a constant or slightly varying level all along the sheet. Thus, according to the invention the blade has, beginning from a selected intermediary section, a sheet twisted in one direction which extends towards the root and a sheet twisted in the opposite direction which extends towards the tip. At the place where both sheets meet i.e. where the selected intermediary section is, both sheets have identical profiles but there appears on the blade surface an edge which marks the boundary between sheets of different geometry.

The invention makes it possible to manufacture working blades of a length exceeding that of blades known so far without infringing the limitations brought about by flow considerations and the strength of the rotor. Consequently, due to an increase in the free section of flow through the blade system the possibility of increasing the turbine power per outlet to the condenser has been created with advantages to the cost of turbine construction as it relates to the unit power unit, and indirectly, also to the obtained efficiency.

The subject of the invention is explained in greater detail by means of an example shown in the accompanying drawing.

FIG. 1 presents a lateral view of the working blade.

In FIG. 2 the same blade in shown viewed from the top with a tracing of blade profiles at predetermined points on its length.

Figure 1:
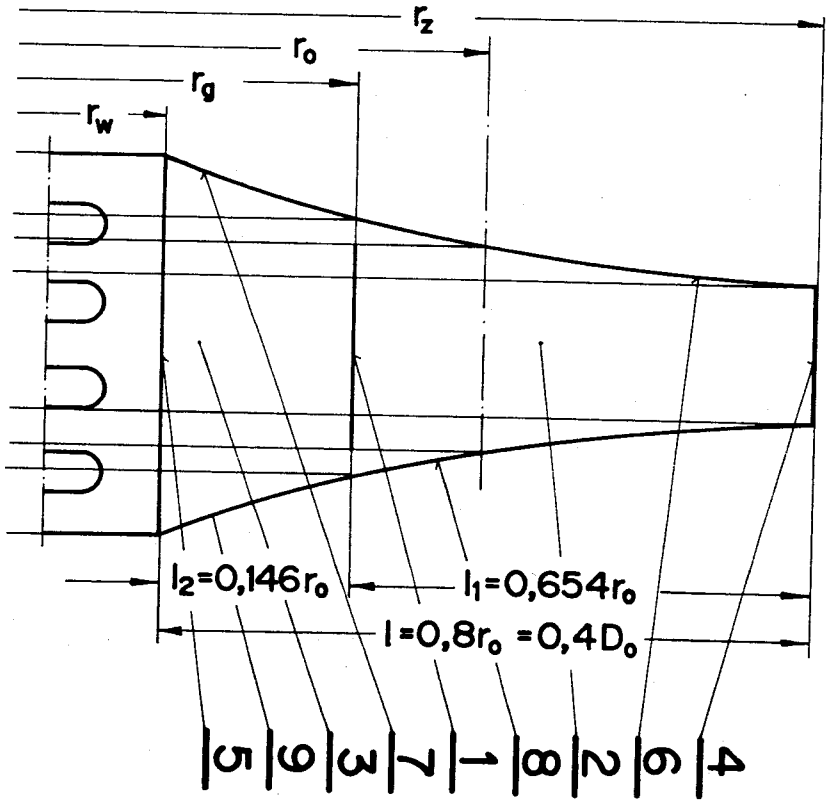

The working blade in the example, which is assumed to be adapted for use at the last stage of a steam turbine, has a ratio $l/d=1/2.5$. This corresponds to a ratio of the inside to the outside radius $r_w/R_z=D_w/D_z=(1-l/d)/(1+l/d)=0.4284$. For the mean radius $r=m_o=(r_w+r_z)/2$ , a degree of reaction $\rho_o=0.50$ is adopted as the most favourable. For $r=r_z=1.4\ r_o$, $\rho_z=0.745$ is obtained therefrom, For $r=r_w=0.6r_o$ in the conventional solution, $\rho_w<0$ is obtained which is not acceptable. The limiting value adopted, namely, $\rho_g=0.1$, occurs when $r_g=0.746\ r_o$ and at this radius occurs the section 1 delimitating an external sheet 2 and an internal sheet 3. The outer boundary of the sheet 2 formed according to the principle of $C_u/r=\text{const}$ is the blade tip 4 at the radius $r=r_z$ where $\rho_z=0.745$. From the section 1 toward the blade root 5 at $r_w=0.6\ r_o$ extends the sheet 3, formed according to the principle of $C_u/r=\text{const}$ with a constant degree of reaction $\rho=0.1=\rho_g=\rho_w$. For the radius $r_w$ the axial component of velocity $C_{aw}=1.1870\ C_{ao}$ i.e. it is 18.7% higher than at the reference radius $r_g$.

For the values given, the blade angles are:

| | |
|---|---|
| $r=r_o$: $-\beta_{10}=74{,}88°$; | $\beta_{20}=24{,}0°$; $\rho_o=0{,}5$ |
| $r=r_z$: $-\beta_{1z}=141{,}9°$; | $\beta_{2z}=18{,}88°$; $\rho_z=0{,}745$ |
| $r=r_g$: $-\beta_{1g}=33{,}22°$; | $\beta_{2g}=28{,}79°$; $\rho_g=0{,}1$ |

and lastly

| | | | |
|---|---|---|---|
| $r=r_w$: $-$ | $\beta_{1w}=43{,}26°$; | $\beta_{2w}=38.30'$; | $\rho_w=0{,}1$ |

It can be seen from the above that the largest obtuse angle of 141.9° at the radius $r=r_z$ gradually decreases toward the root to reach the smallest value of 33.22° at the radius $r=r_g$ and then grows again to the value of 43.26° at the inner, radius $r=r_w$.

Figure 2:
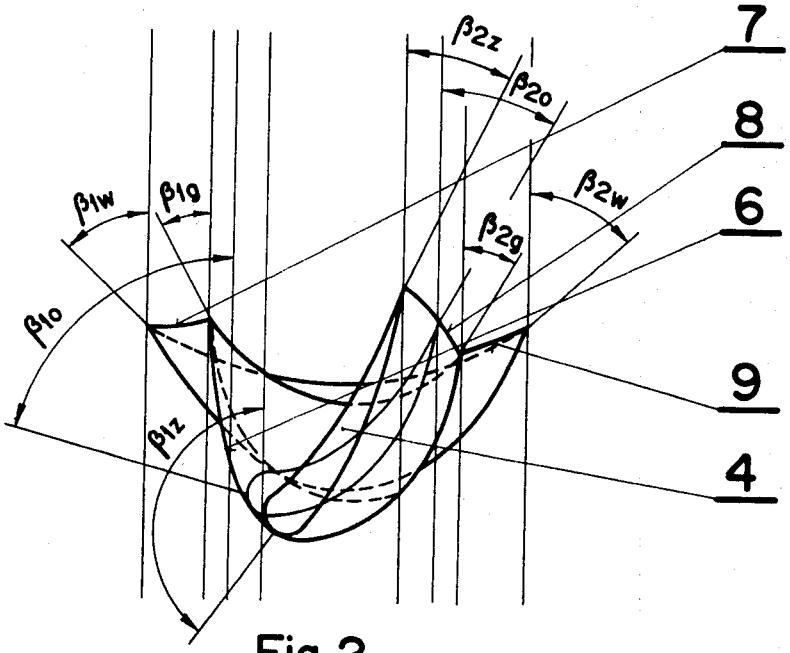
Figure 3:
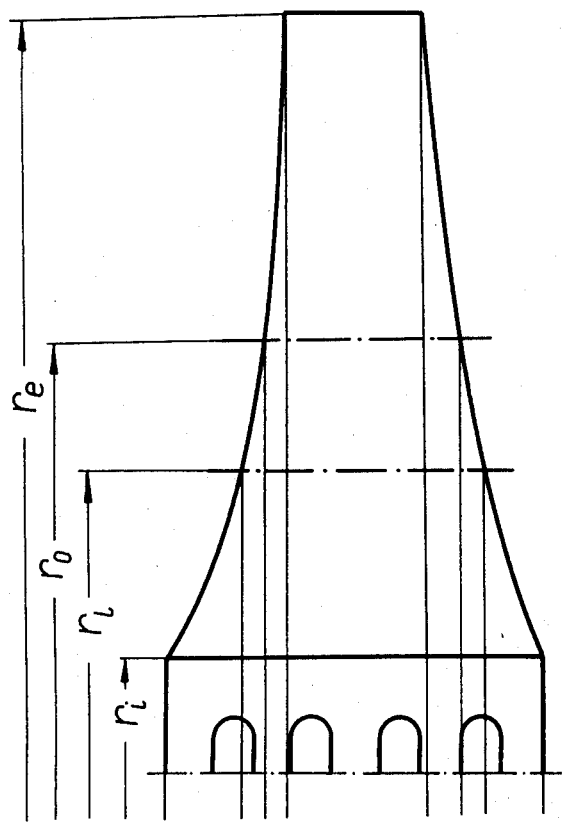
FIG. 3 is identical to FIG. 1 with nomenclature conforming to FIG. 4.

The variability of upper-sheet 2 and lower-sheet 3 angles is reflected in the form of the lateral blade edges as shown in FIG. 2, of the drawing. The edge 6 of sheet 2 and the cooperating sector 7 forming the edge of sheet 3 as well as the edge composed of sectors 8 and 9, respectively exhibit an inflection which corresponds to the location on the blade of the section 1.

Figure 4:
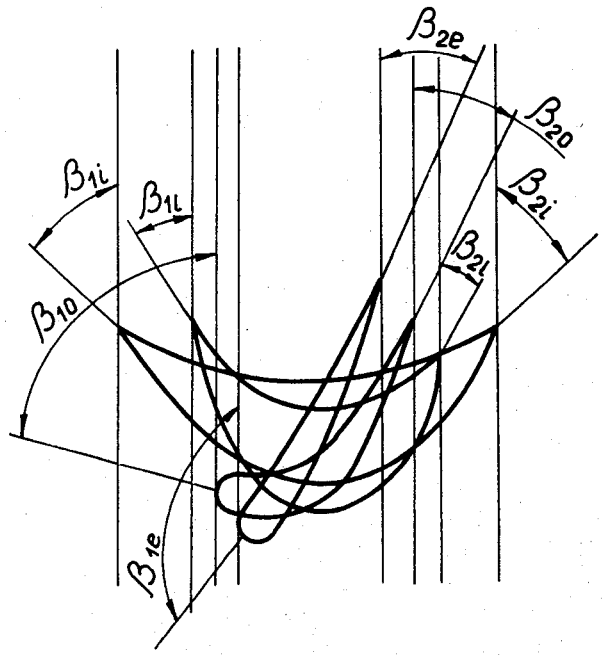
FIG. 4 illustrates the variation of blade angles along the length of a blade and in particular the entry flow angle $\beta_1$ diminishing from an obtuse angle at the blade tip down to a minimum value at a predetermined radius of division of the whole blade into two portions of different vortex-flow patterns and then increasing again down to the root section.

The following table comprises inlet and outlet angles as well as the degree of reaction for 4 characteristic cross-sections of the blade /numerical example/ as it relates to FIG. 4.

| | | | |
|---|---|---|---|
| $r=r_i$ | $\beta_1°=43{,}5$ | $\beta_2°=38{,}5$ | $R=0{,}1$ |
| $r_l$ | 33,5 | 28,8 | 0,1 |
| $r_o$ | 74,9 | 24,0 | 0,5 |
| $r_e$ | 141,9 | 18,9 | 0,745 |

By analogy, a blade can be assembled of two sheets one of which is formed according to the law $C_u \cdot r=\text{const}$. It extends from the root radius $r=r_w$ to the appropriate limiting radius and then passes on to the second sheet which is formed according to the law $C_u/r=\text{const}$ and extends to $r=r_z$ i.e. to the blade tip.

What is claimed is:

1. An axial flow turbomachine rotor blade twisted from root to the tip in order to match fluid angles at entry and exit at different radii, according to a predetermined vortex flow pattern, said blade being tapered simultaneously in order to continuously reduce the cross-section from root to the tip, wherein: entry flow angles first diminish continuously from a large value at blade tip down to a minimum value at a predetermined radius of division of the whole blade length into two portions of different vortex-flow patterns, and then said angles increase again down to the root section, and having the exit angle changing continuously from tip to the root in one direction.

* * * * *